US007147024B2

(12) United States Patent
Kause

(10) Patent No.: US 7,147,024 B2
(45) Date of Patent: Dec. 12, 2006

(54) METHOD TO PRODUCE A DECAY RESISTANT AND WEATHERPROOF WOODEN PRODUCT WITH QUALITIES LIKE HARDWOOD

(76) Inventor: Jaakko Kause, Kausentie 230, FI-27510 Eura (FI)

( * ) Notice: Subject to any disclaimer, the term of this patent is extended or adjusted under 35 U.S.C. 154(b) by 0 days.

(21) Appl. No.: 10/517,597

(22) PCT Filed: Jun. 12, 2003

(86) PCT No.: PCT/FI03/00467

§ 371 (c)(1),
(2), (4) Date: Dec. 13, 2004

(87) PCT Pub. No.: WO03/106126

PCT Pub. Date: Dec. 24, 2003

(65) Prior Publication Data

US 2005/0241730 A1 Nov. 3, 2005

(30) Foreign Application Priority Data

Jun. 12, 2002 (FI) ..... 20021127

(51) Int. Cl.
*B27M 1/00* (2006.01)

(52) U.S. Cl. ..... 144/380; 144/329; 144/359; 100/38; 100/41; 100/42; 100/317; 100/232; 100/240

(58) Field of Classification Search ..... 144/329, 144/380, 359, 364, 2.1, 4.2; 100/38, 41, 100/42, 179, 315–317, 240, 245, 232
See application file for complete search history.

(56) References Cited

U.S. PATENT DOCUMENTS

| | | | | | |
|---|---|---|---|---|---|
| 3,694,992 | A | * | 10/1972 | Hunt | 53/438 |
| 4,606,388 | A | * | 8/1986 | Favot | 144/361 |
| 5,190,088 | A | * | 3/1993 | Thomassen et al. | 144/361 |
| 5,203,261 | A | * | 4/1993 | Davis | 100/42 |
| 5,343,913 | A | | 9/1994 | Tanahasi et al. | |
| 5,662,760 | A | * | 9/1997 | Tsuda | 156/264 |
| 5,685,353 | A | * | 11/1997 | Viitaniemi et al. | 144/361 |

FOREIGN PATENT DOCUMENTS

| | | | |
|---|---|---|---|
| CN | 1307958 | A | 8/2001 |
| DE | 3148120 | A1 | 8/1982 |
| FI | 933611 | | 2/1995 |
| JP | 10235613 | A | 9/1998 |
| JP | 2002127108 | A | 5/2002 |
| SU | 1625695 | | 2/1991 |
| WO | WO 9420273 | A1 * | 9/1994 |
| WO | WO 9429089 | A1 * | 12/1994 |

* cited by examiner

*Primary Examiner*—Bena Miller
(74) *Attorney, Agent, or Firm*—Stites & Harbison PLLC; Douglas E. Jackson

(57) ABSTRACT

A method to produce a decay resistant and weatherproof wooden product (11) and to its qualities like hardwood, for instance teak, in compressing and heating wood block (1) into a wanted shape. In the method a dried wood block (1) is compressed at least in one direction and the compressed wood block (1 kept in compressed shape, for instance between walls (6); (7), and shifted into a heating chamber, which to its cross-section is a closed chamber of predetermined shape and free from oxygen, whereby still in the said chamber the temperature of timber block (11) is quickly raised to 210–390° C. and the timber block kept tight under controlled compression in each direction and that the timber block (11), still under compression, is quickly and controllably cooled, for instance placing it in a space between cooling walls (8).

10 Claims, 1 Drawing Sheet

METHOD TO PRODUCE A DECAY RESISTANT AND WEATHERPROOF WOODEN PRODUCT WITH QUALITIES LIKE HARDWOOD

The invention relates to a method, where from different kinds of wood blocks, for instance birch, a wood product is produced, which to its qualities, for instance decay resistance and weather-resistance, is similar to durable wood and, furthermore, with respect to its stability, colour, hardness and bending strength, it is possible to achieve an end product replacing teak and similar to teak.

It is known that by compression the wood can be made harder and thus suitable for a lot of purposes requiring wear-resistance and strength. In the wood compression process the wood pores get blocked or smaller and the homogeneity changed. Such kinds of compression processes are known among other things from the Finnish patent publications FI-92920 and FI-92919 and the heating process of wood is known for instance from patent publication FI-102694 B relating to drying of wood.

In patent publications FI-92920 and FI-92919 solutions are presented, such as compression of wood with the wood in its initial state rather moist and then quick heating or at first heat treatment and then compression, by means of which solutions one can get the wood to change, for instance to correspond to teak with respect to its hardness and bending strength, but neither weather nor moisture, nor dark colour and decay resistance can be achieved into it. On the contrary, the aim is to retain the original natural colour of wood as exact as possible.

In patent publication FI-102694 B a wood drying method is presented with the wood blocks in controllable condition in order to prevent defects from arising in wood on using a temperature somewhat higher than usually. Then the wood may turn slightly darker than the original wood, mainly in the wood surface portion. Accordingly, it is not possible even by means of the above mentioned drying process to achieve an end product as by means of the method according to the actual invention.

By means of the now actual invention the aim is to produce an end product of a kind that can, observed from the ecological view, be advantageously used to replace timber raw materials treated against decay with poisonous substances. In addition, with the method an end product can be manufactured to replace teak, for instance, thanks to its dyeing, hardness, bending strength and it tolerance to weather and moisture.

The method according to this invention is characterized in that in the method a wood block dried in advance is compressed in one direction and the compressed wood retained in dried condition, for instance between walls, and shifted into a heating chamber, which to its cross-section is a closed chamber of predetermined shape and free from oxygen, whereby still in the said chamber the temperature of the timber block is quickly raised to 210–390° C. and the wood block kept tight under controlled compression from each direction and that the wood block, still under compression, is cooled quickly and controllably, for instance placing it in a space between cooling walls.

Essential for the method of this invention is that after compression of the wood, the heated smooth metal surfaces, which form the cross-section space of the heating section, retain the wood blocks, which are shifted into this space, in their predestined form and under compression, whereby from these wood blocks a completely uniform unit free from oxygen is formed together with a tunnel shaped outer bark.

The essential concept of this invention is that it is possible to use considerably higher temperatures in comparison with former solutions and to heat a compressed wood block immediately to a temperature of 210–390° C. and to prevent the wood from burning, from becoming crooked and from cracking. At the same time an end product with a smooth outer face is achieved and also straight and to its external dimensions of a predetermined shape and size, which as such is ready for use in many places without any further measures.

Essential is that in the method as per the invention the thermal conductivity of the wood block is improved considerably and due to this and the interaction of temperature the total time required in the method is much shorter, only ab. 1–5 hours in comparison with processing times (36–60 h) required in known modifications of heat, whereby a substantially remarkable saving of time and energy is reached. The thermal conductivity improved thanks to compression shortens the heating time of wood and thus the order of handling wood, compression at first and then heating is most advantageous.

In the following the invention is disclosed with reference to the enclosed drawing figures, where FIG. 1 shows a side view of the wood compressing, heating and cooling apparatus.

Figure 1:
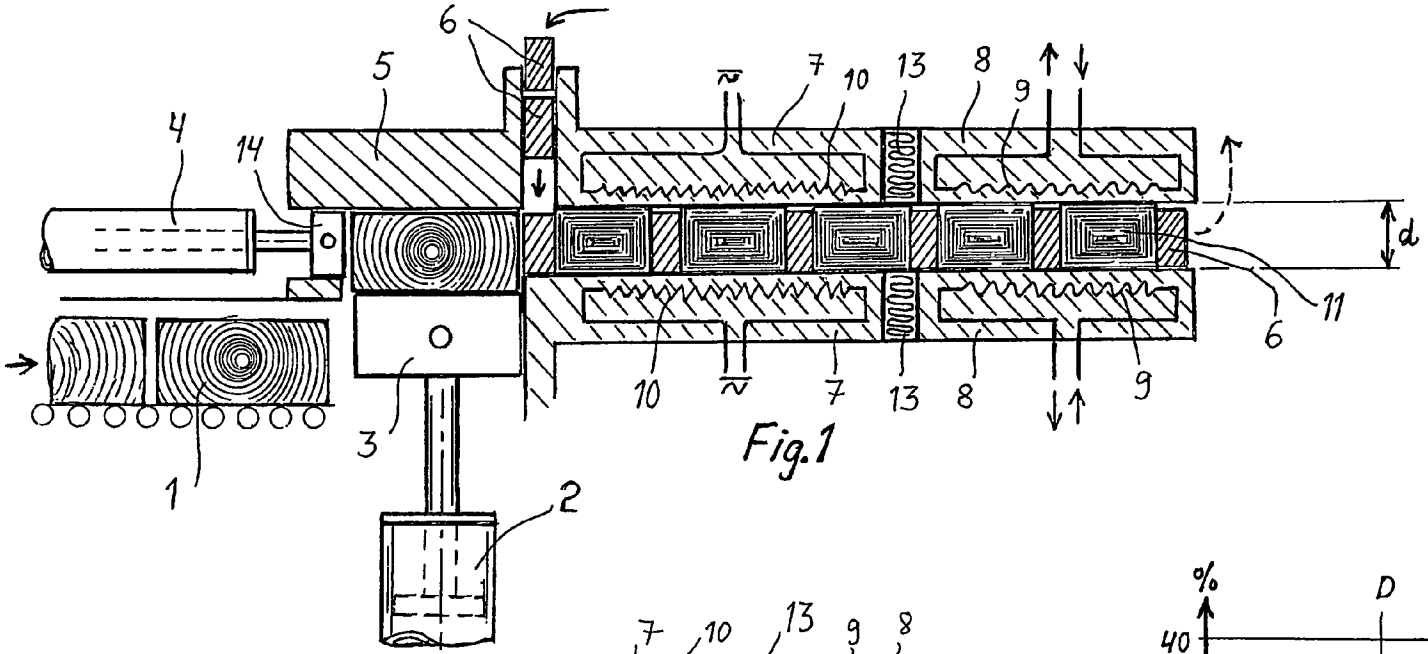

FIG. 1 is a wood processing apparatus by means of which wood handling according to this invention can be carried out. Sawn, dry timber, to its cross-section rectangular and dried less than 18%, is shifted over into the apparatus to be lifted and pressed against counterpart 3 of cylinder 2. If lifted only in this direction, sliding part 14 only prevents wood from swelling sideways. If pressed also by cylinder 4, it is done in this position. Intermediate bearing 6, to be let down from above, is locked into its position as shown in figure and working as counterpart, while pressing wood block 1 by means of cylinder 4. It is also possible to press merely with cylinder 4, whereby sliding part 3 of cylinder 2 works as counterpart preventing swelling of wood.

After this, as per the FIG. 1, intermediate bearing 6 is released from locking and then by cylinder 4 timber block 11 and intermediate bearing 6 are pushed in between walls 7. By means of sliding part 14 it is pushed over to locating space of intermediate part 6 so that on pulling back the sliding part 14 the intermediate bearing can be at first placed as counterpart for the next compression and then shifted forward. The latter wood block and the intermediate bearing always push the former ones forward. As to their height, intermediate bearings 6 are clearly lower than the than the space between the walls. In this way it is secured that the timber block will for sure be in contact with the walls.

Timber block 11 gets at first into the heating section, where metal walls, most suitably aluminum walls 7, work as contact faces for block 11. Walls 7 define a heating chamber with a cross-section which is closed, which is a predetermined shape, and which is free of oxygen. Heating of walls takes place by means of heating elements 10. The temperature of timber block 11 is in this section raised at least to 210° C. Also higher temperatures up to 390° C. come into question. Due to the impact of temperature the lignins, resins and other substances contained in the wood become soften and the timber block homogenous.

Before the cooling section there is a heat insulated zone 13, after passing of which wooden block 11 gets into the cooling section that is formed of metallic, most suitably of aluminium walls 8, within which there is a canalization 9 for cooling liquid. In the cooling section it is the aim to cool the timber block completely, also from the inside to 50° C. whereby the different components in the timber block congeal and even on leaving the cooling section the timber block will retain the forms it had in the final stage of cooling. Intermediate bearings are returned to recycling and ready processed timber blocks continue to the site of use.

Distance d of walls 7 an 8 is adjustable for wood blocks of different size. Likewise, counterpart 5 of the compression section is movable Before compression, the wood block can also be treated with a substance to change its qualities, for instance with fire-retardant.

In one embodiment example the compression section is a separate unit, from which compressed blocks 11 are shifted over to the heating/cooling unit elsewhere.

Figure 2:
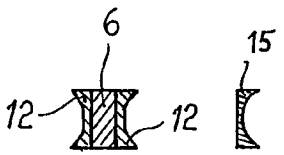
FIG. 2 shows some intermediate bearing solutions.

In FIG. 2 an intermediate bearing 6 is presented into which different shaping pieces 12, 15 can be added depending on the cross-section shape wanted for the wood block.

Figure 3:
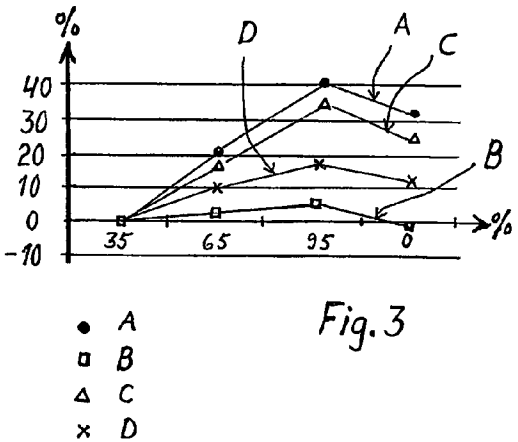
FIG. 3 shows the result of examination of the swelling of wood, with a different degree of moisture, compressed by different ways.

FIG. 3 presents the test results of an examination of the impact of moisture on swelling in the wood compression direction among wood blocks compressed in different ways. By the vertical axis the degree of compression is shown in percents. By the horizontal axis the relative air humidity under the influence of which the wood block is put. The wood blocks were of birch, compressed in the direction the radius with following outcome:

| | |
|---|---|
| Curve A | pressing 38% |
| Curve B | pressing 38% + heat treating |
| Curve C | heat treating + pressing 38% |
| Curve D | heat treating + pressing 22% |

Curve B presents a wood block at first compressed and then heat treated by means of a method as per this invention, the swelling of which block, according to the test results, is incomparably the smallest due to the impact of moisture. Further, only the wood blocks treated in the way presented by curve B regain after compression their original embodiment size completely.

Figure 4:
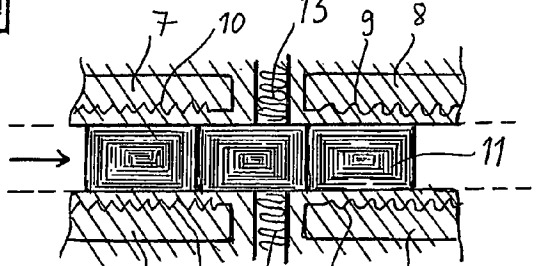
FIG. 4 shows shifting of wood blocks without intermediate bearings.

FIG. 4 shows the shifting of timber blocks 11 through the heating and cooling sections without intermediate bearings. The rectangular shape of timber block 11 allows this and the blocks hold together also in the said embodiment.

The invention is not restricted to the presented embodiments but many modifications are possible within the inventional concept disclosed in the claims. Among other things, in the heating and in the cooling section the walls against block 11 can be, for instance, moving roll mats, if reduction of friction is wanted.

The invention claim is:

1. A method for producing a decay resistant and weatherproof wooden product having qualities like impregnated wood and hardwood, comprising the steps of:

drying a wood block;

pressing the dried wood block at least in one direction to produce a pressed wood block in a pressed shape, shifting the pressed wood block in pressed shape, between heating walls, of a heating chamber, said heating walls forming a closed cross-section of predetermined shape and maintaining the pressed wood block in the pressed shape, heating the pressed wood block in the pressed shape in the heating chamber free from oxygen, quickly to a temperature of 210–390° C., and maintaining the pressed wood block in the heating chamber at the temperature, and cooling the pressed wood block in the pressed shape quickly and controllably between cooling walls of a cooling chamber.

2. A method according to claim 1, wherein said heating and cooling steps are carried out one after another, and further including the step of shifting the pressed block in the pressed shape from between the heating walls to between the cooling walls, such that the heating and cooling walls determine outer dimensions of the pressed wood block.

3. A method according to claim 1, further including the step of heating the wood block before said pressing step.

4. A method according to claim 1, wherein the heating and cooling chambers are placed one after another and the heating and cooling walls form a common channel part, along which pressed wood blocks one after another are shifted through the heating and cooling chambers, a latter pressed wood block pushing a former pressed wood block one of directly or by an intermediate bearing.

5. A method according to claim 4, further including the step of changing a cross-section profile of the pressed wood block to a desired profile by use of an intermediate bearing with a form complementary to the desired profile.

6. A method according to claim 1:

wherein said pressing step is performed at a pressing station, and wherein said pressing station, said heating chamber and said cooling chamber are arranged one after another in a same unit.

7. A method according to claim 1:

wherein said pressing step is performed at a pressing station, and wherein the pressing station, the heating chamber and the cooling chamber are separate units.

8. A method according to claim 1, further including the step if treating the dried wood block before said pressing step with a substance changing a quality of the dried wood block.

9. A method according to any claim 8, wherein the substance is a fire retardant.

10. A method according to claim 1, wherein a degree of moisture of the wood block prior to said pressing step is less than 18%.

* * * * *